United States Patent [19]

Nelson et al.

[11] Patent Number: 4,670,021

[45] Date of Patent: Jun. 2, 1987

[54] DETERGENT AND CORROSION INHIBITING ADDITIVE AND MOTOR FUEL COMPOSITION CONTAINING SAME

[75] Inventors: Edward C. Nelson; William M. Sweeney, both of Wappingers Falls, N.Y.

[73] Assignee: Texaco Inc., White Plains, N.Y.

[21] Appl. No.: 456,885

[22] Filed: Jan. 10, 1983

[51] Int. Cl.[4] ..... C10L 1/22

[52] U.S. Cl. ..... 44/66; 44/73

[58] Field of Search ..... 44/66, 73

[56] References Cited

U.S. PATENT DOCUMENTS 4,456,454 6/1984 Jenkins, Jr. ..... 44/73

*Primary Examiner*—Mrs. Y. Harris-Smith

*Attorney, Agent, or Firm*—Robert A. Kulason; James J. O'Loughlin

[57] ABSTRACT

A novel compound having the following formula:

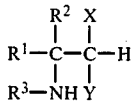

in which $R^1$ and $R^2$ may independently represent a hydrogen radical, a hydrocarbon radical having from 8 to 20 carbon atoms, or an alkoxy substituted hydrocarbon radical of from 8 to 20 carbon atoms having at least one alkoxy substituent; $R^3$ is a hydrocarbon radical having from 8 to 21 carbon atoms or a hydrocarbylamine radical having a molecular weight ranging from 135 to 300;

and X and Y are members selected from the group consisting of —H,—COOH,—CN,—$CONR^4R^5$,—$COR^6$, —$COOR^7$,—$C_6H_5$,—$NO_2$ in which $R^4$, $R^5$, $R^6$ and $R^7$ independently represent a hydrogen radical or a hydrocarbyl radical having from 1 to 20 carbon atoms;

and a detergent and corrosion inhibited fuel composition containing same are provided.

2 Claims, No Drawings

DETERGENT AND CORROSION INHIBITING ADDITIVE AND MOTOR FUEL COMPOSITION CONTAINING SAME

BACKGROUND OF THE INVENTION

1. Field of the Invention

Gasoline compositions are highly refined products. Despite this, they contain minor amounts of impurities which can promote corrosion during the period that the fuel is transported in bulk or held in storage. Corrosion can also occur in the fuel tank, fuel lines and carburetor of a motor vehicle. As a result, a commercial motor fuel composition must contain a corrosion inhibitor to inhibit or prevent corrosion.

In the normal operation of a carburetted internal-combustion engine, a build-up of gasoline insoluble deposits occurs around the throttle plate and throat of the carburetor. The unchecked buildup of these deposits can disturb the efficient metering of fuel to the engine, and may lead to excessive fuel consumption or uneven engine operation, particularly when the engine is running at idle. For this reason, a commercial motor fuel composition must contain a small quantity of a carburetor detergent to keep carburetors operating at maximum efficiency.

An acceptable motor fuel contains additives to correct or inhibit these disabling characteristics of motor fuel. Thus, the discovery of novel and compatible motor fuel additives capable of general application and selective modification to accomodate changing demands while combining good detergency properties with effective corrosion inhibition will provide a material advance in the state of the art.

It has been discovered that several novel reaction products, prepared by a combination of Knoevenagel and Michael reactions, impart improved carburetor detergency to unleaded gasoline. In addition, we have found that these reaction products afford corrosion resistance to automotive fuel systems when blended in unleaded fuels.

2. Description of the Prior Art

In "Potassium Fluoride Catalyzed Reactions Between Malonitrile and Alpha, Beta-Unsaturated Ketones", 48 CANADIAN JOURNAL OF CHEMISTRY, 3064 (1970), ApSimon et al discloses that steric factors affect which competing reaction, the Michael addition or the Knoevenagel condensation, occurs in particular chemical processes.

In "A Novel Thermal Knoevenagel Condensation via a Thermal Michael Reaction", 10 (11) SYNTHETIC COMMUNICATIONS 843-850 (1980) Afzal et al discloses the scope, limitation and mechanism of a Knoevenagel condensation reaction which occurs via a Thermal Michael reaction.

SUMMARY OF THE INVENTION

The additive of the invention, which is effective as a detergent and corrosion inhibitor in hydrocarbon fuel compositions, is the reaction product of an aldehyde or a ketone with a disubstituted hydrocarbon and is represented by the formula:

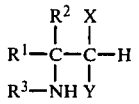

in which $R^1$ and $R^2$ may independently represent a hydrogen radical, a hydrocarbon radical having from 8 to 20 carbon atoms, or an alkoxy substituted hydrocarbon radical of from 8 to 20 carbon atoms having at least one alkoxy substituent;

$R^3$ is a hydrocarbon radical having from 8 to 21 carbon atoms or a hydrocarbylamine radical having a molecular weight ranging from 135 to 300;

and X and Y are members selected from the group consisting of —H,—COOH,—CN,—$CONR^4R^5$,—$COR^6$,—$COOR^7$, —$C_6H_5$ —$NO_2$ in which $R^4$, $R^5$, $R^6$ and $R^7$ independently represent a hydrogen radical or a hydrocarbyl radical having from 1 to 20 carbon atoms;

The reaction product additive of the invention is prepared by reacting an aldehyde or ketone compound represented by the formula:

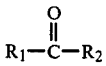

wherein $R^1$ and $R^2$ independently represent a hydrogen radical, a hydrocarbon radical having from 8 to 20 carbon atoms or a substituted hydrocarbon radical of 8 to 20 carbon atoms having at least one alkoxy substituent; with a substantially equimolar amount of a di-substituted hydrocarbon represented by the following formula:

$$Y—CH_2—X$$

wherein X and Y are members selected from the group consisting of —H,—COOH,—CN,—$CONR^4R^5$, —$COR^6$,—$COOR^7$,—$C_6H_5$,—$NO_2$ in which $R^4$, $R^5$, $R^6$ and $R^7$ independently represent a hydrogen radical or a hydrocarbyl radical having from 1 to 20 carbon atoms;

in the presence of a primary amine catalyst under condensation reaction conditions including a temperature ranging from 20° to 300° F., to form an intermediate reaction product, and further reacting said intermediate reaction product with a substantially equimolar amount of a primary amine having the formula:

$$R^3—NH_2$$

wherein $R^3$ is hydrocarbon having from 8 to 21 carbon atoms or an hydrocarbylamine having a molecular weight ranging from 135 to 300 under addition reaction conditions including a temperature ranging from 20° to 300° F.

The fuel composition of the invention comprises hydrocarbons boiling in the 45° to 580° F. range and an amount of the novel additive of the invention effective for imparting detergency corrosion inhibition or thermal stability to the fuel composition.

DETAILED DESCRIPTION OF THE INVENTION

The additive of the invention, which is effective as a detergent and corrosion inhibitor in hydrocarbon fuel compositions is represented by the formula:

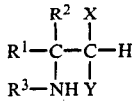

in which $R^1$ and $R^2$ may independently represent a hydrogen radical, a hydrocarbon radical having from 8 to 20 carbon atoms, or an alkoxy substituted hydrocarbon radical of from 8 to 20 carbon atoms having at least one alkoxy substituent;

$R^3$ is a hydrocarbon radical having from 8 to 21 carbon atoms or a hydrocarbylamine radical having a molecular weight ranging from 135 to 300;

and X and Y are members selected from the group consisting of —H,—COOH,—CN,—$CONR^4R^5$,—$COR^6$,—$COOR^7$, —$C_6H_5$,—$NO_2$ in which $R^4$, $R^5$, $R^6$ and $R^7$ independently represent a hydrogen radical or a hydrocarbyl radical having from 1 to 20 carbon atoms.

A more preferred class of compounds of the invention is represented by the formula:

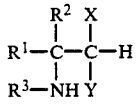

in which $R^1$ and $R^2$ may independently represent a hydrogen radical, a hydrocarbon radical having from 10 to 14 carbon atoms, or an alkoxy substituted hydrocarbon radical of from 10 to 14 carbon atoms having at least one alkoxy substituent;

$R^3$ is a hydrogen radical, a hydrocarbon radical, having from 8 to 21 carbon atoms or a hydrocarbylamine radical having a molecular weight ranging from 135 to 300;

and X and Y are members selected from the group consisting of —COOH, and —CN. The most preferred additive is that represented by the formula:

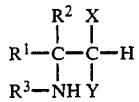

in which $R^1$ and $R^2$ may independently represent a hydrogen radical or a hydrocarbon radical having about 12 carbon atoms;

$R^3$ is a mixture of hydrocarbon radicals having from 12 to 20 carbon atoms;

which X and Y are members selected from the group consisting of —COOH, and —CN.

The preparation of the detergent and corrosion accomplished in two steps. First a hydrocarbyl substituted aldehyde or ketone is reacted with a disubstituted hydrocarbon compound to form an intermediate reaction product. This is commonly known as a Knoevenagel substitution reaction which is a conventional reaction, generally conducted in the presence of a catalyst and in a solvent at an elevated temperature.

The intermediate product produced by the Koevenagel substitution reaction is then further reacted with a primary amine under addition reaction conditions to form the claimed detergent and corrosion inhibiting reaction product additive. The second step is commonly referred to as a Michael addition reaction and is also a conventional reaction.

The hydrocarbyl substituted aldehyde or ketone reactant may be represented by the formula:

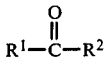

wherein $R^1$ and $R^2$ may independently represent a hydrogen radical, a hydrocarbon radical having from 8 to 20 carbon atoms or an alkoxy substituted hydrocarbon radical of 8 to 20 carbon atoms having at least one alkoxy substituent.

Preferably $R^1$ and $R^2$ independently represent a hydrogen, a hydrocarbon radical having from 10 to 14 carbon atoms or a substituted hydrocarbon radical of from 10 to 14 carbon atoms having at least one alkoxy substituent, and most preferably $R^1$ and $R^2$ independently represent a hydrogen, or a hydrocarbon radical having about twelve carbon atoms.

The disubstituted hydrocarbon reactant may be represented by the following formula:

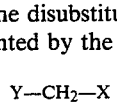

wherein X and Y are members selected from the group consisting of —H,—COOH,—CN,—$CONR^4R^5$,—$COR^6$,—$COOR^7$, —$C_6H_5$, —$NO_2$ in which $R^4$, $R^5$, $R^6$ and $R^7$ independently represent a hydrogen radical or a hydrocarbyl radical having from 8 to 21 carbon atoms. Preferably X and Y are selected from the group consisting of —COOH and —CN.

In general, substantially equimolar amounts of aldehyde or ketone and disubstituted hydrocarbon compound are reacted in the presence of a catalyst at temperatures ranging from 20° to 300° F. to form an intermediate reaction product. Preferred temperatures range from 100° to 200° F. with a most preferred temperature range of from 120° to 160° F.

Compounds which may be employed as catalysts are primary, secondary, and tertiary amines and ammonia with the preferred catalysts being primary amines having from 1 to 20 carbon atoms and the most preferred catalyst being Armeen T which is the tallow amine product of the Armak Co having the following characteristics: a maximum of 95% primary amine; a maximum of 5% combined secondary and tertiary amine; a minimum Iodine value of 38.0 and a maximum of 54.0; a minimum Amine No. of 204 and a maximum moisture of 1.0%.

The intermediate product formed in the first step of the reaction is represented by the following formula:

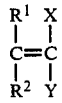

wherein $R^1$ and $R^2$ may independently represent a hydrogen radical, a hydrocarbon radical having from 8 to 20 carbon atoms or an alkoxy substituted hydrocarbon radical of about 8 to 20 carbon atoms having at least one alkoxy substituent and wherein X and Y are members selected from the group consisting of —H,—COOH-,—CN,—$CON^4R^5$,—$COR^6$,—$COOR^7$, —$C_6H_5$,—$NO_2$ in which $R^4$,$R^5$,$R^6$ and $R^7$ independently represent a hydrogen radical or a hydrocarbyl radical having from 8 to 21 carbon atoms.

In the second step of the reaction, the intermediate product is further reacted with a amine which may be represented by the following formula:

$$R^3—NH_2$$

wherein $R^3$ is hydrocarbon having from 8 to 20 carbon atoms or an hydrocarbylamine having a molecular weight ranging from 135 to 300.

Preferably $R^3$ is a hydrocarbon having from 10 to 18 carbon atoms, or a hydrocarbylamine having a molecular weight ranging from 160 to 280. Most preferably $R^3$ is a mixture of hydrocarbons having from 15 to 18 carbon atoms or N-oleyl-amino propane.

Suitable amine reactants include tallow amine; N-oleyl-1,3, diamino propane; octylamine; decylamine; dodecylamine; pentadecylamine; heptadecylamine and icosylamine.

In general the intermediate product is reacted with the amine reactant in from a 1:0.5 to 1:1.5 molar proportions. Preferably the molar proportions of these reactants are substantially equal. The final reaction product is then conveniently recovered and employed in a hydrocarbon solvent.

The following examples illustrate the preparation of specific reaction products which are effective detergents and corrosion inhibitors in fuel compositions:

EXAMPLE I

Synthesis of the Reaction Product of Malonic Acid, Dodecyl Aldehyde and Tallowamine 52 g (0.50 mol) of malonic acid, 110 ml (0.50 mol) of dodecyl aldehyde, 13.4 g of Armeen T and 450 ml of toluene were combined in a 2-liter, 3-necked round-bottomed flask which was equipped with an overhead stirrer, a reflux condenser, a Dean-Stark tube and a heating mantle. 2.8 mls (0.05 mol) of acetic acid were added and the mixture was stirred for 1 hour at room temperature, and then finally refluxed for an additional 2 hours. At the end of that time, 8.9 mls. of water had been azeotroped into the Dean-Stark tube. The mixture was cooled to room temperature, extracted twice using 100 mls of water each time and diluted to a total volume of 500 mls. with toluene. Then 250 mls. (one half) of this cloudy, yellow organic reaction mixture, 67.3 g (0.25 mol) of Armeen T, and 5 ml of distilled water were combined in a 1-liter, 3-necked round-bottom flask which was equipped with an overhead stirrer, reflux condenser and heating mantle. The mixture was refluxed for 1.5 hrs., cooled to room temperature, and concentrated under reduced pressure to give a clear yellow oil which solidified to a pasty yellow mass (117 g) on cooling. Analysis of the product provided the following information:

| Analysis | Found | Calculated |
|---|---|---|
| Mol wt | 510 | 501 |
| Total Acid No | 107.7 | 111.9 |
| Total Base No | 103.2 | 111.9 |
| wt % N | 2.96 | 2.79 |
| IR ($cm^{-1}$) | 3400 to 2600 | |
| | 1638 | |
| Carbon NMR (delta) | 180.4 | |

These data indicate that the reaction product is minimally 93% pure material having the following structure:

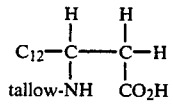

EXAMPLE II

Synthesis of the Reaction Product of Cyanoacetic Acid, Dodecyl Aldehyde and Tallowamine 42.2 g (0.50 mol) of cyanoacetic acid, 110 ml (0.50 mol) of dodecyl aldehyde, 2 g of Armeen T and 220 ml of toluene were combined in a 2-liter, 3-necked, round-bottom flask which was equipped with a overhead stirrer, a reflux condenser a Dean-Stark tube and heating mantle. The mixture was stirred and refluxed for 2 hrs. during whichtime 8 ml of water were collected in the Dean-Stark tube. The reaction mixture was cooled and diluted with toluene to a total volume of 500 mls. Then 250 mls. (one half) of this cloudy, yellow organic solution and 68 g (0.25 mol) of Armeen T were combined in a 1 liter, 3-necked-round-bottom flask which was equipped with an overhead stirrer, reflux condenser and heating mantle. This brown mixture was stirred for 1 hr., refluxed for 1 hr. and then cooled to room temperature. Filtration and concentration under reduced pressure yielded 118 g of a deep-brown liquid product which on analysis gave the following results:

| Analysis | Found | Calculated |
|---|---|---|
| Total Base No. | 105.0 | 106.6 |
| Total Acid No. | 12.1 | 5.3 |
| wt % N | 5.1 | 5.3 |
| IR ($cm^{-1}$) | 3320 | |
| | 2240 | |
| | 2220 | |
| Carbon NMR (delta) | 118 | |
| | 118.5 | |
| | 165 | |
| Proton NMR (delta) | 5.3 multiplet | |

These data indicate that the product is about 90% pure beta-aminotrile having the following structure:

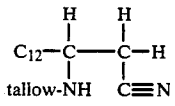

and about 10% pure beta-amino-cyanoacetic acid having the following structure:

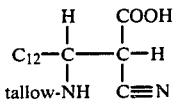

EXAMPLE III

Synthesis of the Reaction Product of Cyanoacetamide, Dodecyl Aldehyde and Tallowamine The same procedure as described in Example II was followed except that instead of 0.5 mol of cyanoacetic acid, 42 g (0.05 mol) of cyanoacetamide were employed. Analysis of the product provided the following results:

| Analysis | Found | Calculated |
|---|---|---|
| Total Acid No. | 15.1 | 0 |
| Total Base No. | 61.4 | 107 |
| wt % N | 6.45 | 8.0 |
| IR ($cm^{-1}$) | 3300 | |
| | 3200 | |
| Carbon NMR (delta) | 118.3 | |
| | 167 | |

These data indicate that the reaction product was a mixture of the following additive compounds:

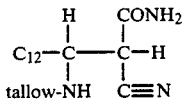

and

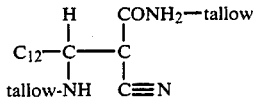

and the following alpha, beta unsaturated compounds:

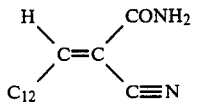

and

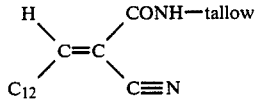

EXAMPLE IV

Synthesis of the Reaction Product of Malonic Acid 3,7-Dimethyl-7-Methoxy-Octanal and N-Oleyl-1,3 Diamino Propane 52 g (0.50 mol) of malonic acid, 0.50 mol of 3,7-dimethyl-7-methoxy octanal, 3 g (0.05 mol) of Armeen T, and 200 ml of toluene were combined in a 2-liter, 3-necked round-bottom flask which was equipped with an overhead stirrer, reflux condenser, Dean-Stark tube and heating mantle. The mixture was stirred and then refluxed for 2 hrs. during which time 8.9 mls. of water were azeotroped into the Dean-Stark tube. The mixture was cooled, and then diluted to a total volume of 500 ml with toluene. 250 mls. (one half) of the cloudy, yellow organic solution, 105 g (0.25 mol) of DUOMEEN OL (which is a mixture of N-alkyl 1,3 diamino propanes wherein the alkyl is 3.5% N-tetradecyl, 0.5% pentadecyl, 4.0% hexadecyl , 1.0% peptadecyl, 16.0% octadecyl, 1.5% tetradecenyl, 5.0% hexadecenyl 65.0% octadecenyl and 3.0% octadecadienyl) were combined in a 1-liter, 3-necked round-bottomed flask which was equipped with an overhead stirrer, reflux condenser and heating mantle. The mixture was stirred for 1 hr., refluxed for 1 hr. and then cooled to room temperature. Filtration and concentration under reduced pressure yielded a clear yellow oil which solidified to a pasty yellow mass weighing 117 g on cooling. Analysis of the product yielded the following results:

| Analysis | Found | Calculated |
|---|---|---|
| Total Acid No. | 119 | 104 |
| Total Base No. | 177 | 208 |
| wt % N | 4.6 | 5.2 |
| IR ($cm^{-}$) | 3420 | |
| | 3300 | |
| | 1680–1550 | |
| Proton NMR (delta) | 7.6 | |
| | 5.4 multiplet | |
| | 3.2 singlet | |
| Carbon NMR (delta) | 178.6 | |
| | 74.5 | |
| | 48.9 | |

These data indicate that the reaction product is predominantly a compound having the following structure:

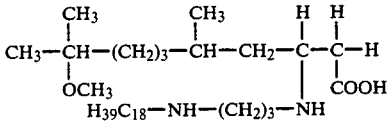

The mineral oil composition of the invention comprises a mixture of hydrocarbons boiling in the range from about 80° to about 1000° F. containing an effective detergent, corrosion-inhibiting, and thermal stabilizing amount of the prescribed additive. More specifically, the additive is effective as a detergent and corrosion inhibitor in a gasoline motor fuel composition consisting of a mixture of hydrocarbons boiling from about 85° to 450° F., and as a thermal stabilizer in middle distillate fuel compositions, such as jet fuel, boiling from about 400° F. to 572° F.

The gasoline motor fuel which is benefited by the additive of the invention may be leaded or unleaded and may consist of straight-chain or branched-chain paraffins, cycloparaffins, olefins, and aromatic hydrocarbons and mixtures of these. The base fuel can be derived from straight run naphtha, polymer gasoline, natural gasoline or from catalytically cracked or thermally cracked hydrocarbons and catalytically reformed stocks. The hydrocarbon composition and the octane level of the base fuel are not generally critical. Any conventional motor fuel base may be employed in the practice of this invention.

The additive of the invention also improves the thermal stability of jet fuel obtained by conventional refining processes as well as jet fuel comprising up to 20% low quality fuel oil obtained from shale, tar sands or by the H-oil process.

In general, the additive of the invention is added to a mineral oil composition in a minor amount, i.e., an amount effective to provide detergency and/or corrosion inhibition and/or thermal stability to the oil composition. The additive is effective in a mineral oil in an amount ranging from about 0.001 to 0.3 weight percent based on the total composition. To impart detergent and corrosion inhibiting properties to a gasoline fuel composition, an amount ranging from about 0.001 to 0.2 weight percent is preferred with the most preferred concentration ranging from about 0.002 to 0.10 weight percent. To improve thermal stability in a jet fuel from about 0.1 to 0.3 weight percent is preferred with the most preferred concentration ranging from about 0.15 to 0.25 weight percent.

A fuel composition containing the additive of the invention can contain other additives normally employed in a fuel composition. For example, the base fuel may be blended with an anti-knock compound, such as tetraalkyl lead compound, including tetraethyl lead, tetramethyl lead tetrabutyl lead, or mixtures thereof, generally in a concentration from about 0.01 to 4.0 cc. per gallon of gasoline. The tetraethyl lead mixture commercially available for automotive use will also contain an ethylene chloride-ethylene bromide mixture as a scavenger for removing lead combustion products from the engine. The fuel composition may also be augmented with anti-icing additives, corrosion inhibitors, intake system deposits modifiers, dispersants, upper cylinder lubricants and the like.

The fuel additive of the invention was tested for its effectiveness as a detergent in gasoline in the Chevrolet Carburetor Detergency Test Phase III. In this test, a gasoline fuel composition containing the additive of the invention is tested for its ability to remove preformed deposits from the throttle plate area in a carburetor. This test is run on a Chevrolet V-8 engine mounted on a test stand using a modified four-barrel carburetor. The two secondary barrels on the carburetor are sealed. The feed to each of the primary barrels is arranged so that the detergent additive fuel can run in one barrel and a reference fuel or a base fuel run in the other. The primary carburetor barrel was also modified to contain removable aluminum inserts in the throttle plate area so that the deposits formed on the insert could be conveniently weighed.

The engine is run for a period of time usually 24 or 48 hours using the base fuel as the feed to both barrels with the engine blow-by circulated to the air inlet of the carburetor to cause a deposits build-up. The weight of the deposits on both sleeves is determined and recorded. The engine is then cycled for 24 additional hours with the reference fuel or base fuel being fed to one barrel and the additive fuel to the other. During this cycle, engine blow-by is circulated to the air inlet of the carburetor. The inserts are then removed from the carburetor and weighed to determine the difference between the performances of the additive-containing fuel of the invention and the reference fuel or base fuel for removing preformed deposits. After the aluminium inserts have been cleaned, they are replaced in the carburetor and the process repeated with the fuel feed inlet to the carburetor reversed in order to minimize differences in fuel distribution and carburetor construction. The results obtained in the fuel runs are averaged and the effectiveness of the reference fuel and of the additive fuel for removing deposits expressed in percent.

The base fuel employed for demonstrating the detergency and corrosion inhibition effectiveness of the additive composition of the invention was an unleaded grade gasoline having a Research Octane Number of about 95.8, and Motor Octane Number of 85.1. This gasoline consisted of about 33.5% aromatic hydrocarbons, 14.0% olefinic hydrocarbons and 52.5% paraffinic hydrocarbons and boiled in a range from 83° F. to 411° F.

The carburetor detergency test results obtained from the base fuel, comparison fuels and the fuel compositions containing the additive prepared are set forth in Table I below:

TABLE I

CHEVROLET CARBURETOR DETERGENCY TEST[a]

| Run No. | Fuel Composition | Deposit Build-up, mg.[b] | Deposit Removed, mg. | Average Weight % Effective |
|---|---|---|---|---|
| 1. | Commercial Detergent Fuel | 15.3 | 8.8 | 58 |
| | Base Fuel + 20 PTB[c] of Example I | 14.0 | 10.0 | 73 |
| 2. | Commercial Detergent Fuel | 12.8 | 4.7 | 37 |
| | Base Fuel + 20 PTB of Example II | 13.6 | 6.8 | 50 |
| 3. | Commercial Detergent Fuel | 14.0 | 9.9 | 71 |
| | Base Fuel + 20 PTB of Example III | 11.8 | 8.9 | 76 |
| 4. | Commercial Detergent Fuel | 9.7 | 2.2 | 23 |
| | Base Fuel + 20 PTB of Example IV | 11.8 | 4.0 | 34 |

[a]Clean-up type test.
[b]Built up with base fuel.
[c]PTB—pounds of additive per 1000 barrels of fuel.

The fuel composition containing the reaction product additive of the invention was outstanding as a carburetor detergent for removing preformed deposits from the throttle plate area of the carburetor.

The foregoing results demonstrate that the novel fuel additives of the invention were suprisingly effective for achieving carburetor cleanliness as measured by the Chevrolet Carburetor Detergency Test.

The improvement in the detergency property of the novel fuel compositions of the invention from the use of the novel detergent additives is a noteworthy advance in the provision of a modern detergent fuel composition.

The rust inhibiting effect of the fuel composition of the present invention was determined in the National Association of Corrosion Engineers Test (NACE).

In this test a mixture of 300 ml of test gasoline and 30 ml distilled water is stirred at a temperature of 37.8° C. (100° F.) with a steel specimen completely immersed therein for a test period of 3½ hours. The percentage of the specimen that has rust is determined visually and noted.

The fuel compositions tested were a mixture of base fuel and varying concentrations of the additives of Examples I through IV. Each fuel concentration was run three times and the minimum amounts of inventive additive required to consistently pass (give less than 5% corrosion) in all three runs are set forth below in Table II.

TABLE II

NACE RUST TEST

| Additive in Unleaded Base Fuel | % Rust[(a)] |
|---|---|
| 5 PTB[(b)] of Example I | less than 5% |
| 20 PTB of Example II | less than 5% |

TABLE II-continued

| NACE RUST TEST | |
|---|---|
| Additive in Unleaded Base Fuel | % Rust[a] |
| 20 PTB of Example III | 10 to 50% |
| 2.5 PTB of Example IV | less than 5% |
| Premium commercial fuel | less than 5% |

[a]less than 5% passes test

[b]PTB = Pounds of additive per 1000 barrels of fuel.

The foregoing results demonstrate that certain additives of the invention, i.e. Examples I, II and IV were surprisingly effective in preventing the formation of rust and the corrosion of the metal surfaces with which the fuel was in contact.

We claim:

1. A motor fuel composition comprising a mixture of hydrocarbons boiling in the range from about 85° to 450° F. and from about 0.001 to 0.3 weight percent of a compound produced from the reaction of malonic acid, dodecyl aldehyde and tallowamine represented by the formula:

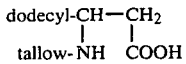

2. A motor fuel composition according to claim 1 containing from about 0.002 to 0.10 weight percent of said compound.

* * * * *